US006257476B1

(12) United States Patent
Ehmig

(10) Patent No.: US 6,257,476 B1
(45) Date of Patent: Jul. 10, 2001

(54) EXPLOSIVE POWDER ACTUATED SETTING TOOL

(75) Inventor: Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/500,302

(22) Filed: Feb. 8, 2000

(30) Foreign Application Priority Data

Feb. 9, 1999 (DE) ..... 199 05 216

(51) Int. Cl.[7] ..... B25C 1/08
(52) U.S. Cl. ..... 227/10
(58) Field of Search ..... 227/9, 10, 11, 227/8; 173/209; 60/637, 632; 89/1.14

(56) References Cited

U.S. PATENT DOCUMENTS

| | | | | |
|---|---|---|---|---|
| 3,162,123 | * | 12/1964 | Turner | 227/9 |
| 3,490,673 | * | 1/1970 | Diehl | 227/10 |
| 3,709,421 | * | 1/1973 | Kolmar | 227/10 |
| 3,851,416 | * | 12/1974 | Engstrom et al. | 227/10 |
| 4,037,770 | * | 7/1977 | Dorgnon et al. | 227/9 |
| 4,218,005 | * | 8/1980 | Harris | 227/10 |
| 4,655,380 | * | 4/1987 | Haytayan | 227/10 |
| 5,749,509 | * | 5/1998 | Remeroski | 227/10 |
| 5,842,623 | * | 12/1998 | Dippold | 227/10 |
| 6,062,455 | * | 5/2000 | Giannuzzi et al. | 227/10 |

FOREIGN PATENT DOCUMENTS

| | | | | |
|---|---|---|---|---|
| 1478837 | | 3/1969 | (DE) . | |
| 2252177 | * | 6/1975 | (FR) | 227/10 |
| 9639281 | | 12/1996 | (WO) . | |

* cited by examiner

*Primary Examiner*—Scott A. Smith
(74) *Attorney, Agent, or Firm*—Sidley Austin Brown & Wood, LLP

(57) ABSTRACT

An explosive powder-actuated setting tool including a guide cylinder (1) having an inner bore (2); a drive piston (3) axially displaceable in the inner core (2); a cartridge socket (5) for receiving a cartridge, and a connection channel (4) connecting the cartridge socket (5) with the inner bore (2) of the guide cylinder (1), with the connection channel (4) having a mouth opening (9) adjoining the cartridge socket (5) and formed of a first, sharp-edged circumferential section (10) and a second circumferential section (11) provided with a radius.

4 Claims, 2 Drawing Sheets

EXPLOSIVE POWDER ACTUATED SETTING TOOL

BACKGROUND OF THE INVENTION

1. Field of the Invention

The present invention relates to an explosive powder-actuated setting tool including a guide cylinder having an inner bore, a drive piston axially dispeaceable in the inner bore, a cartridge socket for receiving a cartridge and an inner diameter of which decreases in a setting direction of the setting tool, and a connection channel connecting the cartridge socket with the inner bore of the guide cylinder with the connection channel having a mouth opening adjoining the cartridge socket.

2. Description of the Prior Art

German Publication DE-0S 14 78 837 discloses a guide cylinder of a setting tool having a cartridge socket and an inner bore. A cartridge socket adjoins, at its end facing in the setting direction, the inner bore. The cartridge socket serves for receiving a propellant charge. A cylindrical connection channel extends between the cartridge socket and the inner bore. The diameter of the connection channel is smaller than the diameter of the cartridge socket. The connection channel has a mouth opening adjacent to the cartridge socket. The mouth opening widens in a direction toward the cartridge socket. The mouth opening is formed by a circular phase.

The setting tool disclosed in the German Publication does not allow for use of film cartridges because the film cartridge, upon the ignition of the propellant charge, would expand into the connection channel in a form of a spherical segment and, at some point, would explode. The remnants of the film cartridge would reach the inner bore and would contaminate it, adversely affecting future functioning of the setting tool.

Accordingly, an object of the present invention is to provide an explosive powder-actuated setting tool in which film cartridges filled with propellant charge can be used, without adversely affecting the subsequent functioning of the setting tool.

Another object of the present invention is to provide an explosive powder-actuated setting tool with means which would insure a simple and reliable ignition of the propellant charge filling a film cartridge.

SUMMARY OF THE INVENTION

These and other objects of the present invention, which will become apparent hereinafter, are achieved by providing an explosive powder-actuated setting tool in which the connection channel is formed of a first, sharp-edged circumferential section and a second circumferential section having a radius.

The first sharp-edged circumferential section provides for breaking down the film cartridge at a precisely defined location and an explosion of the film cartridge after a pressure necessary for complete combustion of the propellant charge has been attained. According to the invention, the second circumferential surface opposes the breaking of the film and insures that each film section which projects into the connection channel remains on the remnant portion of the film and does not reach the inner core of the guide cylinder.

In order to insure that the propellant charge pressure, which is generated upon ignition of the cartridge, reaches the inner bore of the guide cylinder through the connection channel unimpeded and that a connection region between the teared or torn film section and the remained portion of the film is as large as possible, preferably, the second circumferential section extends along maximum a half of an entire circumference of the mouth opening of the connection channel.

In order to insure that a portion of the foil, which projects into the connection channel, has a shape of a tongue with two, extending substantially parallel to each other, side edges and a semicircular end region, preferably, the first circumferential section is U-shaped, and the second circumferential section is linear.

In order to provide for an economical formation of the connection channel, a portion of the connection channel which adjoins the mouth opening and extends in the setting direction of the setting tool, has a cross-section that deviates from a circle.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
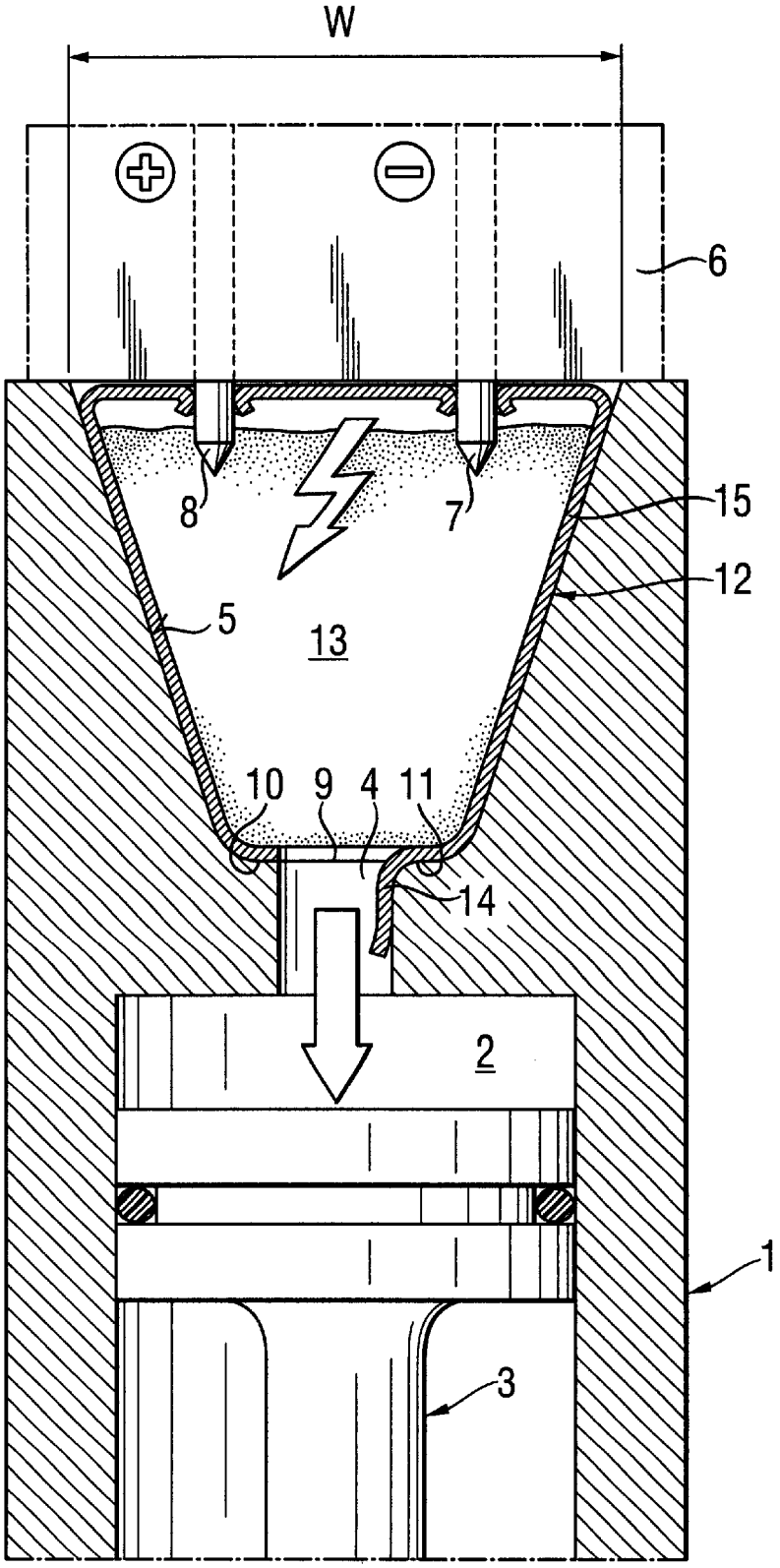
FIG. 1 a partial cross-sectional view of a setting tool with a cartridge socket according to the present invention.
Figure 2:
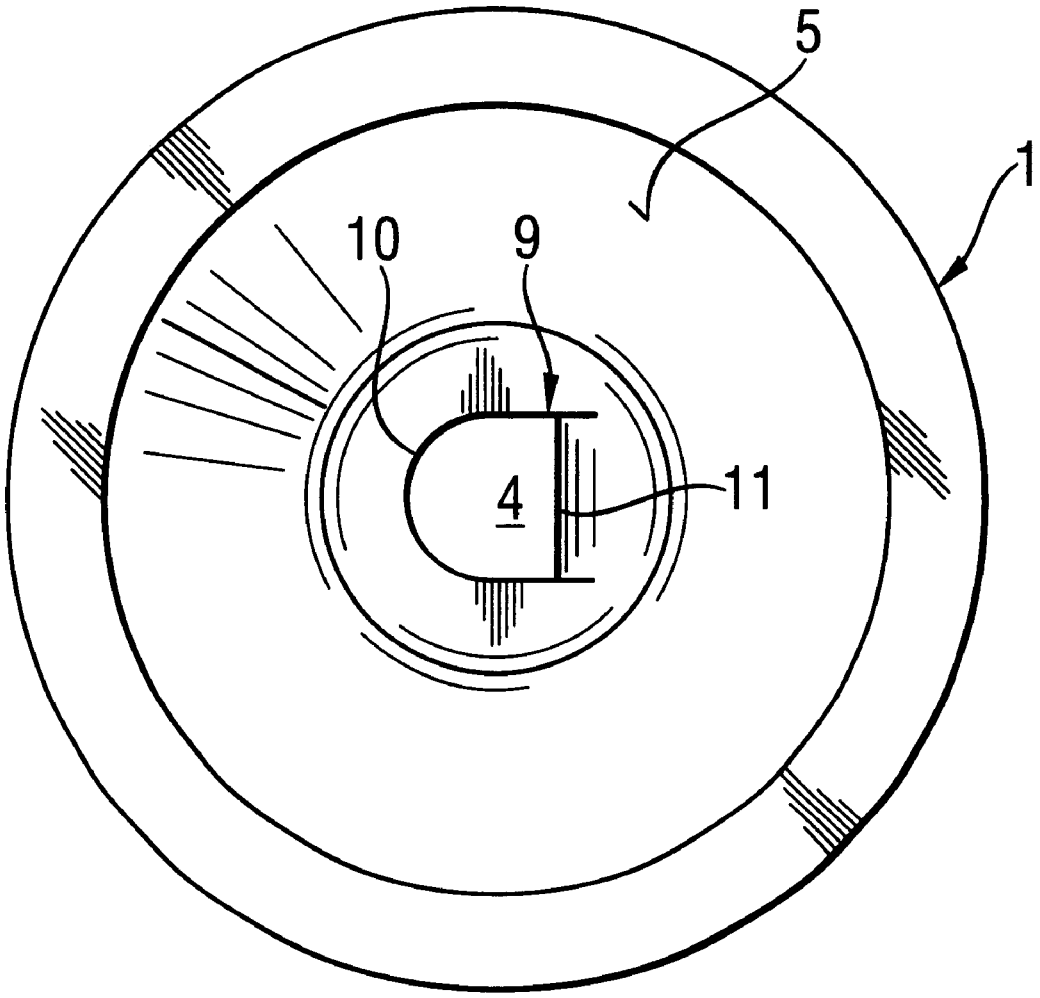
FIG. 2 a plan view of the cartridge socket shown in FIG. 1 together with a connecting channel.

A cartridge socket 5 according to the present invention, which is shown in FIGS. 1–2, adjoins, at its end facing in the setting direction of a setting tool, with which the cartridge socket is used, an inner bore 2 formed in a guide cylinder 1. A drive piston 3 is displaceably arranged in the inner bore 2. A connection channel 4 connects the cartridge socket 5 with the inner bore 2. The connection channel 4 has a cross-section that deviates from a circle. The connection channel 4 has a mouth opening 9 at its end adjoining the cartridge socket 5. The mouth opening 9 is formed of two circumferential sections 10 and 11. The first circumferential section 10 has a sharp edge, whereas the second circumferential section 11 is provided with a radius, e.g., of from 0.5 to 4 mm. The first, sharp-edged circumferential section 10 and the adjoining the circumferential section 10 wall of the connection channel 4 are substantially U-shaped. The second circumferential section 11, which is provided with a radius, and the adjoining the circumferential section 11 wall of the connection channel are formed as linear sections. As shown in FIG. 2, the first circumferential section 10 can be, e.g., double the size of the second circumferential section 11.

A film cartridge 12 is arranged in the cartridge socket 5. The film cartridge 12 is filled with a powdered propellant charge 13. The propellant charge 13 is ignited with two electrodes 6 and 7 between which an arc is formed when the two electrodes 6 and 7 are connected with a power source (not shown), and an electrical current flows through the electrodes 6 and 7. The two electrodes 6 and 7 are fixedly secured in the housing 6 of a setting tool (not shown in detail) with which the cartridge socket is used. The electrodes 6 and 7 extend through the bottom of the film cartridge 12. This bottom and the region 15, in which the propellant charge 13, is received, of the film cartridge 12 are formed of a thin film. A portion of the cartridge 12, which is opposite to the cartridge bottom and is arranged in the region of the mouth opening of the connection channel 4, is lacerated along the first, sharp-edged circumferential section 10 and projects in form of a film tongue 14 past the second circumferential section 11 into the connection channel 4.

Though the present invention was shown and described with references to a preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. An explosive power-actuated setting tool, comprising a guide cylinder (1) having an inner bore (2); a drive piston (3) displaceable in the inner bore (2); a cartridge socket (5) for receiving a cartridge and having an inner diameter which decreases in a setting direction of the setting tool; and a connection channel (4) connecting the cartridge socket (5) with the inner bore (2) of the guide cylinder (1) and having a mouth opening (9) adjoining the cartridge socket (5) at a front, in the setting direction, end of the cartridge socket (5) and having a first, sharp-edge circumferential section (10) and a second circumferential section (11) with a radius.

2. A setting tool according to claim 1, wherein the second circumferential section (11) extends at most along a half of an entire circumference of the mouth opening (9) of the connection channel (4).

3. A setting tool according to claim 1, wherein the first circumferential section (10) is U-shaped, and the second circumferential section (11) is linear.

4. A setting tool according to claim 1, wherein a portion of the connection channel (4), which adjoins the mouth opening (9), has a non-circular cross-section.

* * * * *